US005077858A

United States Patent [19]

Lewis, Jr.

[11] Patent Number: 5,077,858

[45] Date of Patent: Jan. 7, 1992

[54] SPIKE AND CLEAT BRUSH

[75] Inventor: John C. Lewis, Jr., Salisbury, Vt.

[73] Assignee: Oliver Francis Industries, Inc., Bridgeport, N.Y.

[21] Appl. No.: 666,564

[22] Filed: Mar. 8, 1991

Related U.S. Application Data

[63] Continuation of Ser. No. 431,350, Nov. 3, 1989, abandoned.

[51] Int. Cl.[5] ..... A46B 15/00

[52] U.S. Cl. ..... 15/161; 15/217

[58] Field of Search ..... 15/104.92, 112, 161, 15/191 R, 215-217, 237, 238

[56] References Cited

U.S. PATENT DOCUMENTS

| | | | |
|---|---|---|---|
| 1,830,455 | 11/1931 | Zrnel | 15/112 |
| 3,002,211 | 10/1961 | Mathes | 15/112 |
| 3,100,312 | 8/1963 | Williams | 15/215 |
| 3,696,459 | 10/1972 | Kolera et al. | 15/104.92 |
| 3,808,628 | 5/1974 | Betts | 15/238 |
| 4,617,917 | 10/1986 | Miller | 15/161 |

FOREIGN PATENT DOCUMENTS

| | | | |
|---|---|---|---|
| 870167 | 3/1953 | Fed. Rep. of Germany | 15/238 |
| 15040 | of 1884 | United Kingdom | 15/112 |
| 7533 | of 1902 | United Kingdom | 15/112 |
| 6584 | of 1914 | United Kingdom | 15/112 |
| 202590 | 8/1923 | United Kingdom | 15/112 |
| 421835 | 1/1935 | United Kingdom | 15/215 |

*Primary Examiner*—Philip R. Coe
*Assistant Examiner*—Mark Spisich
*Attorney, Agent, or Firm*—Lowe, Price, LeBlanc & Becker

[57] ABSTRACT

An apparatus is disclosed for removing grass and dirt from spikes and cleats mounted on shoes, boots and other foot wear. The tufted device is generally placed upon the ground and spikes or cleats are moved across the device in order to remove unwanted debris. The improved device comprises a hollow base structure having generally smooth inclined sides from which synthetic brush tufts radiate upward, and integral spike-like grabber radiate downward.

5 Claims, 5 Drawing Sheets

SPIKE AND CLEAT BRUSH

This application is a continuation of application Ser. No. 07/431,350 filed Nov. 3, 1989, abandoned.

FIELD OF THE INVENTION

The invention relates to an apparatus for removing debris from spikes and cleats mounted on shoes, boots and other footwear, and in general, is employed while standing over or near the device and moving one shoe or boot across the top of the device to clean debris, and then bringing the other shoe or boot across likewise.

DESCRIPTION OF THE PRIOR ART

Many different types of spike and cleat debris removers have been devised U.S. Pat. Nos. 3,028,617 and 4,571,767 issued to Joseph L. Racina and Charles C. Dangler, respectively, describe brush-type golf shoe cleat cleaners to remove dirt and debris from the spikes. In order to use the above-mentioned devices, one must hold onto a handle means while trying to clean said spikes. In both instances, it is not possible to anchor the brush mat to solid ground.

U.S. Pat. Nos. Des. 256,524 and 293,164 issued to Alan D. Shearer and Robert V. Elliott respectively, illustrate hand held spike and cleat brush-type cleaners. Neither of these devices can be left as a free standing brush in order to remove dirt and debris from the bottoms of shoes and/or boots comprising spikes or cleats.

U.S. Pat. Nos. 3,604,043; 4,291,431 and 4,690,277 issued to John C. Lewis, Jr. disclose tufted fused mat-like devices wherein synthetic filament tufts are fused to molded base sections, however, there is no disclosure therein of the improved objects of the instant invention, nor is it obvious to one skilled in the art to arrive at this new and novel cleaning device.

SUMMARY OF THE INVENTION

The instant invention over comes the inadequacies in the prior art by providing a mat of integral synthetic filament tufts radiating upward from a hollow molded base, said base having generally smooth angled inclined sides and integral spike-like grabbers radiating downward from said molded base, in order that said device be placed upon the ground or turf, and pass a shoe or boot parallely along the ground while engaging the spikes or cleats of the shoe with the brush tufts and thus removing the dirt and debris. The improvement of many spike-like grabbers on the under side of the mat, which act to secure the said mat firmly in the ground, and the hollow area under the mat, which allows the turf to collect up inside (under) the molded base and the inclined angle sides of the said mat base, allowing the free gliding of a spike or cleat over the brush tufts, thus not allowing the spike or cleat to engage the edges of the molded base, which would cause the device to separate and break loose from the ground clearly impart new and novel functions to this device.

The improved device generally includes a base portion, angled inclined sides, integrally fused synthetic filament tufts, integrally molded grabbers radiating downward from said base, place for attachment means and a hollow honey-comb under portion.

It is therefore an object of this invention to provide a spike and cleat cleaning device which is self-supporting and can be securely held in the ground during use.

Another object of this instant invention is to provide a portable device which can easily be stored or carried in a bag; i.e., golf bag, knapsack, sports equipment bag and the like.

A further object of this invention is to provide an integrally molded/fused device having the minimum raw material in its design in order to meet future ecology and recycling criteria.

These and other objects will become readily apparent with reference to the drawings and following description wherein:

DESCRIPTION OF THE PREFERRED EMBODIMENT

Figure 1:
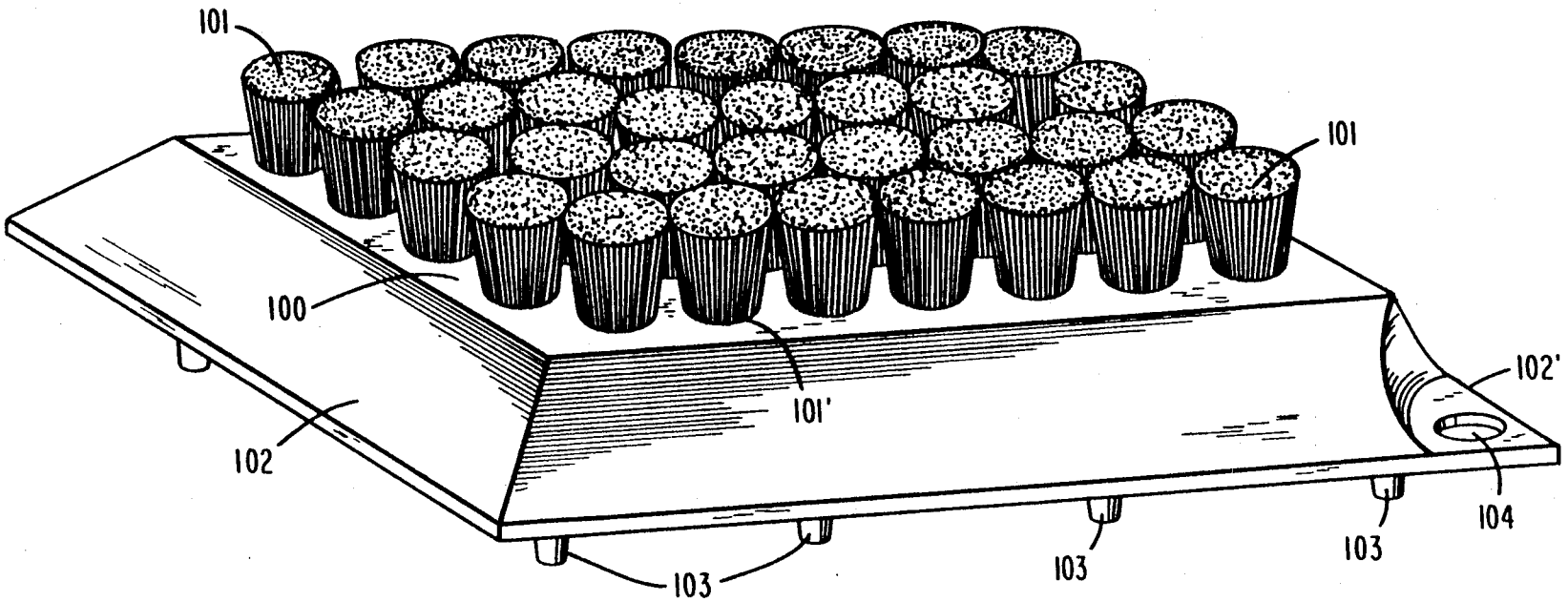
FIG. 1 is a perspective view of the spike and cleat cleaning device.
Figure 5:
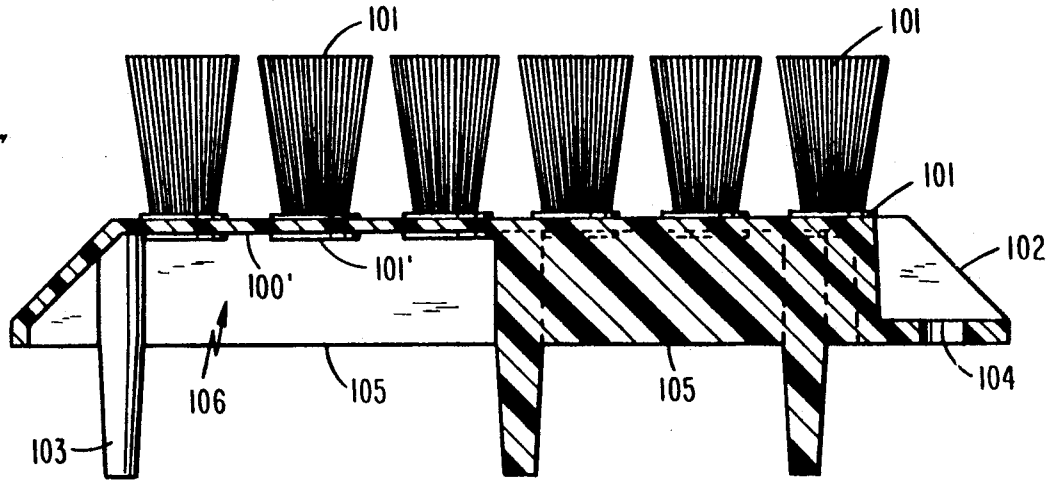
FIG. 5 is a cross-sectional view of FIG. 4 as taken along line A—A of FIG. 4.
Figure 6:
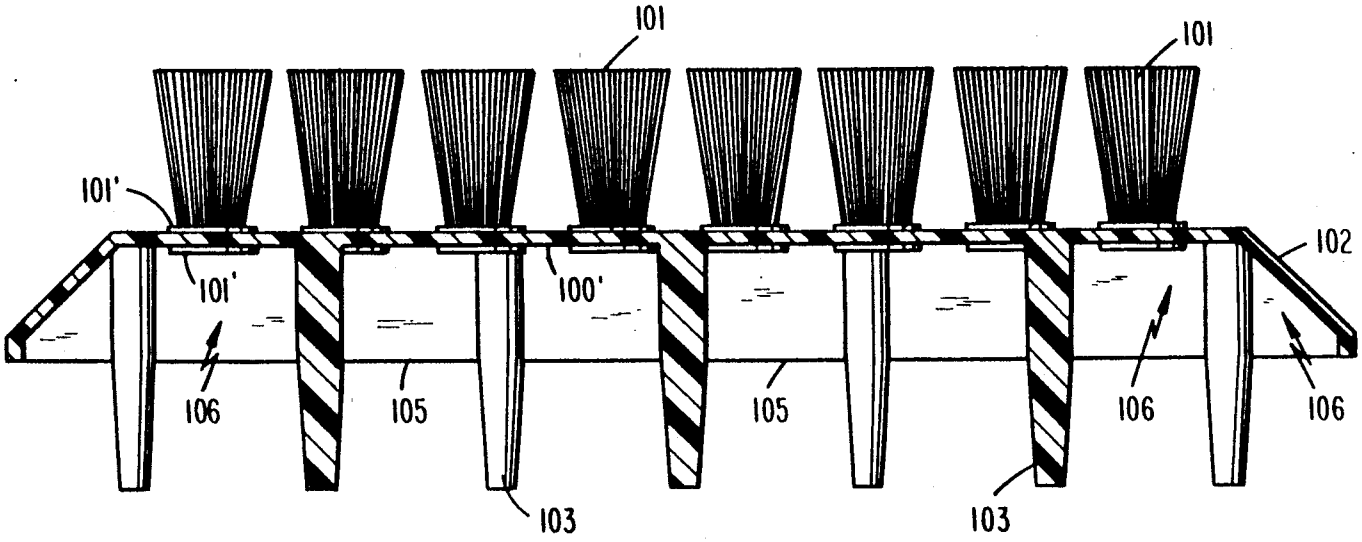
FIG. 6 is a cross-sectional view similar to FIG. 5 but taken through the length of the device of this invention.

The spike and cleat cleaner of this invention is shown in FIG. 1, in perspective. The device consists of a molded base mat 100 which has integrally fused synthetic brush tufts 101 radiating upwardly from non-working fused ends 101'. Inclined or angle side panels 102 are integral with base mat 100 and provide a non-abrupt or non-vertical side to the base of the mat 100. Non-vertical sides 102 function to stabilize the device of this invention when in use as will be subsequently explained. Spike-like grabbers 103 radiate downwardly from the underside 100' of the base mat 100 as shown, for example, in FIGS. 5 and 6. A means of attachment 104 to a foreign body is provided and molded into the side of the mat at tab edge 102'.

With reference to FIGS. 3–6, there is illustrated the proportions and placement of the components of the instant invention. Spike-like grabbers 103 radiate downwardly from under-surface 101' and a hollow space 106 is created between the sides 102 and the top mat 100'. Thin integral webs 105 extend across the hollow space 106 to provide reinforcement.

Figure 2:
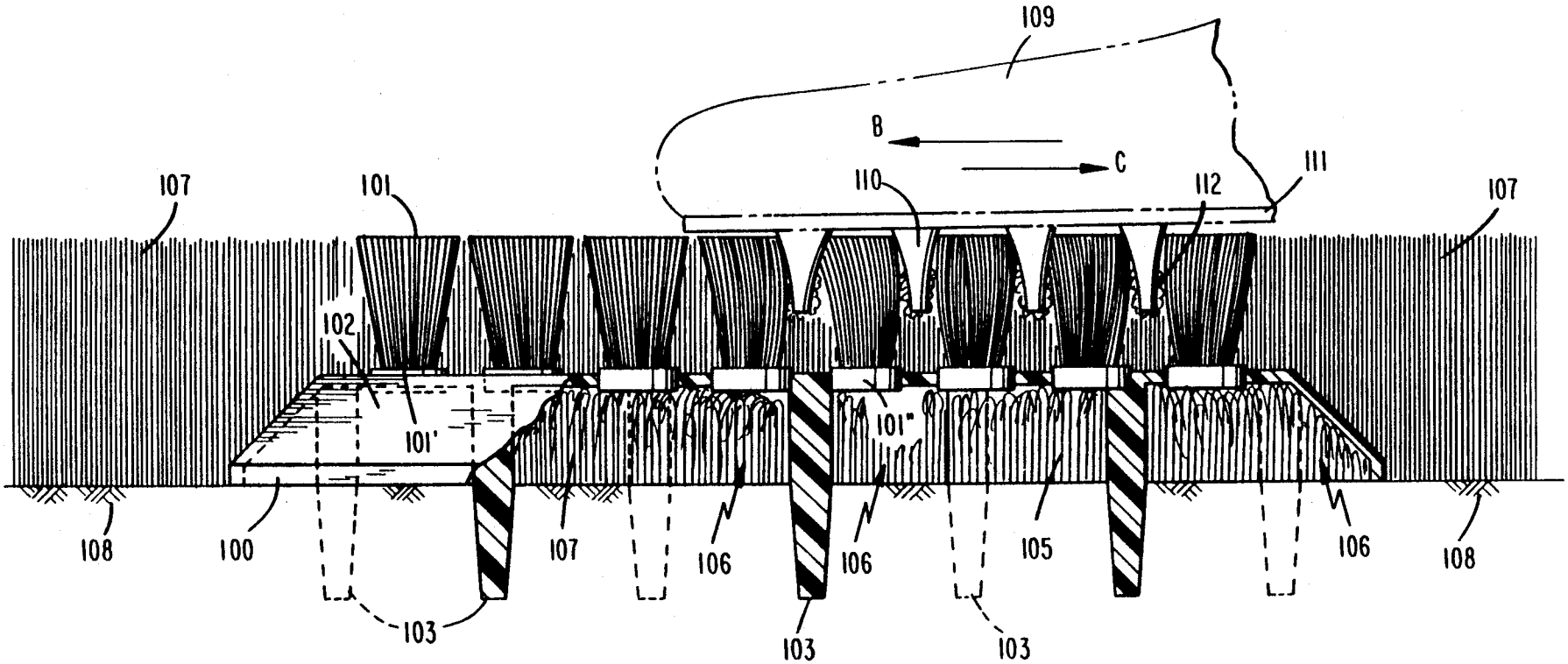
FIG. 2 is a cross-sectional view of the spike and cleat cleaning device illustrating its use to clean and remove debris.
Figure 3:
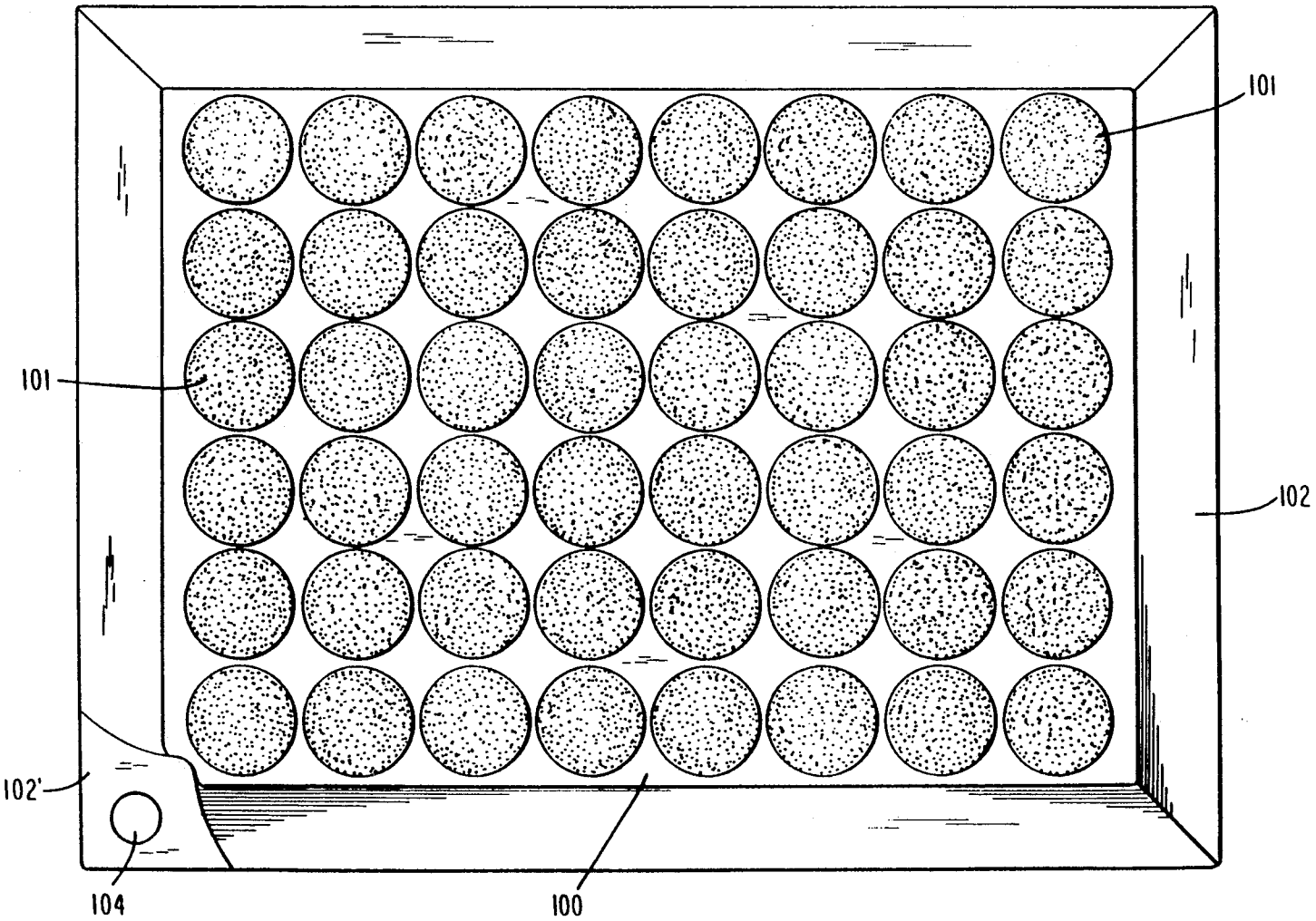
FIG. 3 is a top view of the cleaning device illustrating the brush tuft surface and hang-up means.
Figure 4:
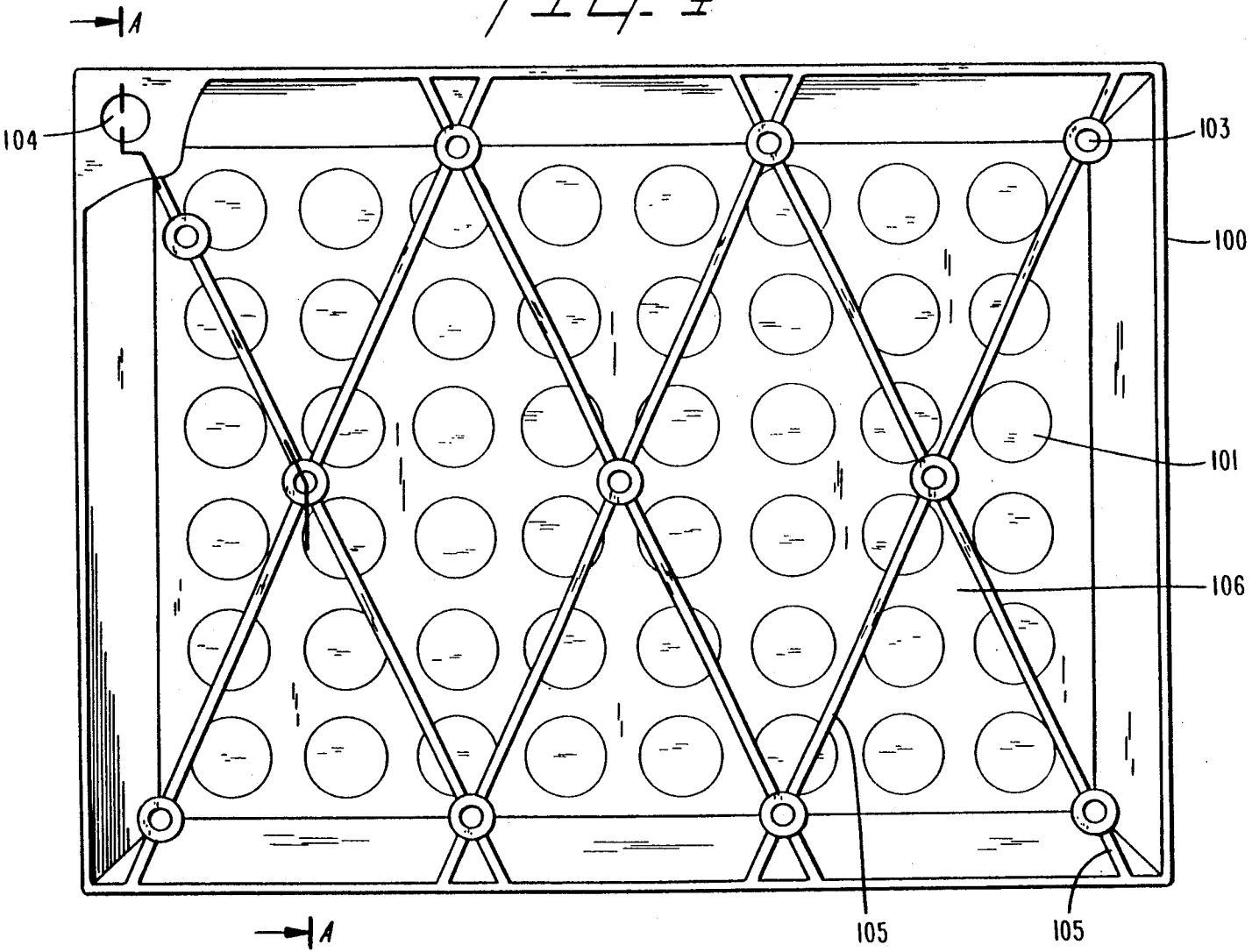
FIG. 4 is an underside view of the cleaning device illustrating the honey-comb structure and grabber means.

With reference to FIG. 2, the spike and cleat cleaner of this invention 100 is placed upon the ground and stepped upon from the top of said filament tufts 101 in order to drive the spike-like grabbers 103 into the turf 107 and into the supporting dirt 108 as shown. Turf or grass 107 is allowed to collect under the molded base 100 in the hollow portion 106 so that it does not interfere with base 100 lying flat on the ground 108. In general, the top of the tufts 101 should lie close to the surface of the tips of the grass 107 so that tufts 101 do not radiate substantially above the grass.

In order to clean cleats then a shoe 109 containing spikes 110 fastened to the sole 111 is moved back and forth in the directions B and C as shown in FIG. 2 so that debris 112 embedded between spikes 110 is brushed away and allowed to fall free. Sides 102 act to stabilize the device during this action and minimize the possibility that a spike 110 will contact the side. If sides 102 were vertical, a spike could engage the side and flip the device over much more easily.

Obviously, many modifications and variations of the instant invention are possible in light of the above teachings. The device may be made from polypropylene molded resin and fused synthetic polypropylene monofilament as the preferred material. However, other synthetic resins such as polyesters, polystyrenes, polyamides, and the like may be used. Filament diameters and cross-sectional shapes may also be varied with the diameters ranging from 0.005 through 0.050 inches. Cross-sectional shapes from circular, "X" and "Y" and other shapes could also be used thus imparting different cleaning attributes within the mat structure.

The base member may have a circular shape as well as any polygonal shape so long as it is possible to create an inclined side portion, hollow-like space under the top of the base and spike-like grabber projections radiating downwardly from the underside of said base.

The preferred embodiment describes a mat with four angled inclined sides so as to be usable from any direction. However, the device of the instant invention needs only one angled inclined side in order to be completely functional.

The device may be employed to clean a wide variety of items from golf shoes, hiking and working boots, football and soccer cleats and other footwear.

The invention may be embodied in other specified forms without departing from the spirit or essential characteristics thereto. The present embodiments are therefore to be considered in all respects as illustrative and not restrictive, the scope of the invention being indicated by the appended claims rather than by the foregoing description, and all changes which may come within the meaning and range of equivalency of the claims are therefore intended to be embraced therein.

I claim:

1. A spike or cleat cleaner device comprising:

a rigid molded synthetic base means adapted for gripping engagement with the ground or turf when cleaning spikes or cleats, said base means comprising a substantially planar mat having upper and lower surfaces and integral side members depending from the periphery thereof and extending outwardly at an acute angle to a first plane containing said mat, said sides and lower surface of said mat forming a generally hollow space, and a plurality of mutually spaced reinforcing ribs extending across and contained within the hollow space between side members and depending from the lower surface of said mat each of said ribs being contained in a second plane normal to the first plane containing said mat and the lower edge of each rib being contained substantially in a third plane containing the lower edge of said side members and disposed parallel to the first plane containing said mat;

a plurality of mutually spaced tufts integrally fused to the upper surface of said mat and extending upwardly therefrom; and a plurality of mutually spaced, integrally molded spike-like projections extending downwardly from the lower surface of said mat each projection extending through a rib and through the third plane whereby when the device is placed on the ground, the device will be supported by edges of the ribs and side members in the third plane with any turf received in the hollow space and stabilized by the projections engaging the ground.

2. The device of claim 1 wherein the molded base shape is rectangular and four inclined sides are provided forming a continuously angled incline surface around the plurality of fused synthetic filament brush tufts.

3. The device of claim 2 whereby the molded base comprises a means for attachment to a foreign object.

4. The device of claim 1 whereby there is located a means for attachment to a foreign object along the base section.

5. The device of claim 1 wherein the molded base, fused brush tufts and spike-like projections are made of polypropylene.

* * * * *